United States Patent [19]

Takatsuka

[11] Patent Number: 4,908,605

[45] Date of Patent: Mar. 13, 1990

[54] DEVICE FOR CONFIRMING WHETHER A LOCK IS LOCKED OR UNLOCKED

[75] Inventor: Jitsuho Takatsuka, Yokohama, Japan

[73] Assignee: Hiroshi Hasegawa, Tokyo, Japan

[21] Appl. No.: 168,257

[22] Filed: Mar. 15, 1988

[51] Int. Cl.[4] ..... E05B 45/06

[52] U.S. Cl. ..... 340/542; 70/432

[58] Field of Search ..... 340/540, 542, 547, 686, 340/63, 426; 70/432, 441, 413; 361/172; 200/61.64, 61.66

[56] References Cited

U.S. PATENT DOCUMENTS

| | | | |
|---|---|---|---|
| 3,579,183 | 5/1971 | Lipschutz | 340/542 X |
| 4,249,161 | 2/1981 | Mohnhaupt | 340/547 X |
| 4,432,218 | 2/1984 | Hoener | 70/432 X |
| 4,438,430 | 3/1984 | Young et al. | 340/547 |
| 4,440,011 | 4/1984 | Klein | 70/432 X |
| 4,631,943 | 12/1986 | Hoener | 70/432 X |

FOREIGN PATENT DOCUMENTS

| | | |
|---|---|---|
| 50-143695 | 11/1975 | Japan . |
| 50-144598 | 11/1975 | Japan . |
| 50-149493 | 11/1975 | Japan . |
| 50-161398 | 12/1975 | Japan . |
| 51-028099 | 3/1976 | Japan . |
| 51-051996 | 4/1976 | Japan . |
| 51-066094 | 5/1976 | Japan . |
| 51-080494 | 7/1976 | Japan . |
| 53-017497 | 2/1978 | Japan . |
| 59-188260 | 12/1984 | Japan . |
| 61-47364 | 3/1986 | Japan . |

*Primary Examiner*—Glen R. Swann, III
*Assistant Examiner*—Thomas J. Mullen, Jr.
*Attorney, Agent, or Firm*—Wenderoth, Lind & Ponack

[57] ABSTRACT

A key has reed switches which are disposed within a head of the key, and switch actuators comprising bias magnets disposed adjacent the reed switches, respectively, and a pair of first driving magnets and second driving magnets which are disposed at the front end face of a cylinder lock and alternately magnetized in opposite directions. In response to the close proximity of the bias magnet and its corresponding driving magnet, the corresponding reed switch is actuated according to the mutual coaction between each bias magnet and its corresponding magnet. The rotation of the key for locking the cylinder lock and the rotation of the key for unlocking the cylinder lock are made to correspond with open and closed states of the reed switches, or the most recent of a locking signal and an unlocking signal.

14 Claims, 4 Drawing Sheets

DEVICE FOR CONFIRMING WHETHER A LOCK IS LOCKED OR UNLOCKED

BACKGROUND OF THE INVENTION

The present invention relates to a device for confirming whether or not a cylinder lock is locked, and more particularly a device for confirming whether the cylinder lock is locked in which the ability to confirm whether cylinder lock is locked or unlocked is imparted to a key for the cylinder lock.

For instance, it is impossible to confirm whether a cylinder lock is kept locked or unlocked by merely looking at a corresponding key when one is outside so that there are many persons who feel anxious and return to confirm whether the cylinder lock is closed or not. In order to substantially solve this problem a locking mechanism in which a corresponding key is incorporated with a display device for displaying whether the cylinder lock is locked or not is disclosed in, for instance, Japanese Laid-Open Utility Model Application No. 47364/1986. However, such a locking mechanism can be applied only to an extremely small number of types of cylinder locks and it is impossible in practice to incorporate a single-pole, double-throw switch, which is one of the most important component parts, into a head of the corresponding key, so it will take a long time before such a locking mechanism is used in practice.

Furthermore, a key holding mechanism for controlling the cylinder locks at various shops, offices and so on in a single building by an off-line operation has been devised and used. According to such a mechanism, the last person who leaves a shop or the like inserts a key into a cylinder of this mechanism to lock a cylinder lock and hold (store) the key. The next morning when the first person arrives at the shop, he/she enters a coded number by using a magnetic card or a ten-key keyboard to release and then pull out the key and then uses this key to open the cylinder lock. This mechanism is highly evaluated as the first non-caretaker or self-service control mechanism. However, from the standpoint of safety supervision of the building, this mechanism has a very serious blind point in that it cannot confirm whether a person who has left his/her shop last has completely locked the cylinder lock of his/her shop.

SUMMARY OF THE INVENTION

In view of the above, the primary object of the present invention is to provide a novel device for confirming whether a cylinder lock is locked or not in which a key incorporates the function of confirming whether or not the cylinder lock is locked.

To the above and other ends, the present invention is characterized by one or more reed switches incorporated in a key, and switch driving means comprising one or more bias magnets disposed in the vicinity of the one or more reed switches, respectively. A group of first and second driving magnets are disposed at the front end face of a cylinder lock and are magnetized in the opposite directions, respectively, whereby when each bias magnet and its corresponding driving magnet approach each other, the corresponding reed switch is actuated by the coaction between the bias magnet and its corresponding driving magnet.

According to the present invention, because of the mutual action between the reed switches and the switch actuating means, the of the key in the clockwise and the counter-clockwise directions for closing and opening the cylinder lock can be made to correspond to the opening and closing operations of the reed switches or to the timing of the generation of output signals from the reed switches so that the function of memorizing the history of locking/unlocking can be imparted to the key, whereby the objects of the present invention can be attained.

The actuation of each reed switch is made in response to the magnetic flux of the magnets, not by mechanical contact, so that reliable and dependable actuation can be ensured for a long period of time.

The effects of the present invention remain unchanged by differences in construction of the cylinder locks such as the angular positions at which the driving magnets are disposed, the rotation in the clockwise or counterclockwise direction for lock closure, the alignment or misalignment between the inner and outer cylinders of the cylinder lock and so on.

DETAILED DESCRIPTION OF THE PREFERRED EMBODIMENTS

First Embodiment: FIGS. 1–10

Figure 1:
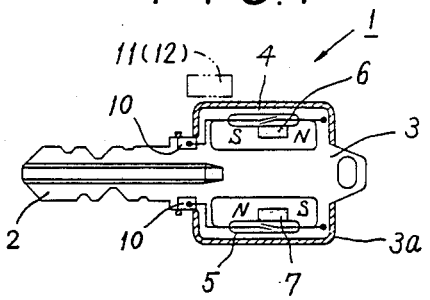
FIG. 1 is a side view in partial section of a key used in a first embodiment of a device for confirming whether a cylinder lock is locked or unlocked.

Referring first to FIG. 1, a generally indicated by the reference number 1 has a shank or main body 2 formed with key grooves like conventional keys, but with a predermined portion of a head or knob 3 cut off and, after component parts to be described below are mounted in the cut-out portion, the latter is covered or sealed with a case 3*a* made of, for instance, a plastic. The shank 2 and the head 3 of the key 1 are formed integrally and are made of an electrically conductive, nonmagnetic material such as brass or the like.

A first reed switch 4 is disposed along one side (the upper side in FIG. 1) of the head 3 and a second reed switch 5 is disposed along the other side (the lower side in FIG. 1) of the head 3. One ends of each of the first and second reed switches 4 and 5 is grounded to the base plate of the head 3 while the other ends thereof are connected to electrodes 10 which are electrically isolated from the base plate.

First and second bias magnets 6 and 7 are disposed in the vicinity of the first and second reed switches 4 and 5. In the first embodiment (FIG. 1), the bias magnets 6 and 7 are directly bonded to the reed switches 4 and 5, respectively, with a suitable adhesive.

The bias magnets 6 and 7 are bar magnets which extend substantially in parallel with the reed switches 4 and 5, respectively. The magnetic flux lines naturally extend from the north pole to the south pole, and the main flux lines, substantially in parallel with the magnet, are directed in the direction in which the key is inserted (to the left in FIG. 1) in the case of the first bias magnet 6 while the main flux lines are directed in the direction in which the key is pulled out in the case of the bias magnet 7. In other words, the direction of the magnetic flux lines of the first bias magnet 6 is opposite to the direction of the magnetic flux lines of the second magnet 7.

The magnetic flux density of each of the first and second bias magnets 6 and 7 is selected at a value such that the bias magnet 6 or 7 alone cannot open or close the corresponding reed switch 4 or 5, but will keep the reed switch 4 or 5 in the closed state once the reed switch 4 and 5 are closed.

Figure 2:
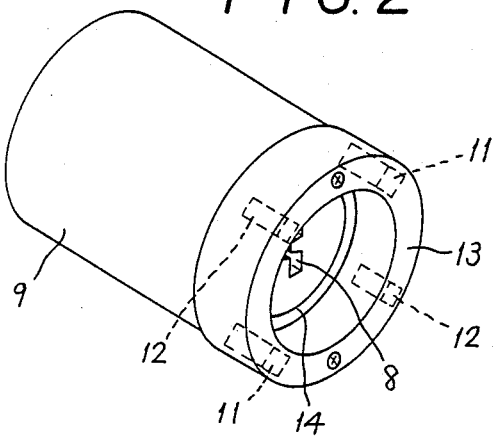
FIG. 2 is a perspective view of a cylinder lock.
Figure 3:
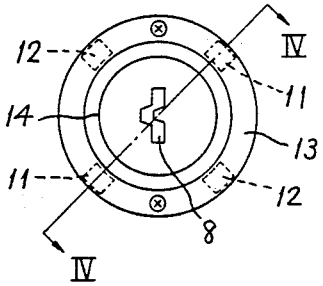
FIG. 3 is a front view of the cylinder lock of FIG. 2.
Figure 4:
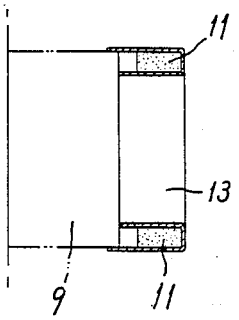
FIG. 4 is a section view of a holder of the cylinder lock taken along the line IV—IV of FIG. 3.

Referring to FIGS. 2–4, two groups or two pairs consisting of the first and the second driving magnets 11, 12 are mounted at the front end face of a cylinder lock 9 with a key hole 8.

In the first embodiment, each of the driving magnets 11 and 12 is inserted into a hole of a ring-shaped holder 13 (shown in FIG. 4) having a substantially U-shaped cross section and is securely bonded with, for instance, an adhesive and thereafter securely attached to the front end face of the cylinder lock 9 through the holder 13, which is attached with setscrews. The holder 13 is made of a non-magnetic material and the empty portions of the circular groove of the holder 13 are, of course, filled with, for example, arcuate spacers (not shown) made of a plastic.

The radial position at which each of the driving magnets 11 and 12 is mounted is so selected that each of the driving magnets 11 is near the locus of the displacement of each of two sides at the end portion of the head of the key (See FIG. 1). In other words, the above-mentioned radial positions of the driving magnets 11 and 12 are so selected that the rotation of the head 3 of the key within the inner hole of the holder 13 is permitted and the driving magnets 11 and 12 are as close as possible to the reed switches 4 and 5 disposed in the vicinity of both sides, respectively, of the head 3 of the key.

As shown in FIGS. 2 and 3, the circumferential positions of the first and second driving magnets are so selected that the first and second driving magnets are disposed in opposing relationship and alternately disposed with respect to the upright position of the key hole 8, which may define a reference line. In the first embodiment, more particularly when the key hole is upright or at a position at which the hour and minute arms of a clock are vertical, the first driving magnets 11 are disposed at positions corresponding to one thirty and seven thirty, while the second driving magnets 12 are disposed at positions corresponding to four thirty and ten thirty. Each first driving magnet is magnetized such that when it is proximity to the reed switch 4, the magnet force lines thereof are exerted in a direction such that the magnetic flux density passing through the reed switch 4 is increased.

Figure 5:
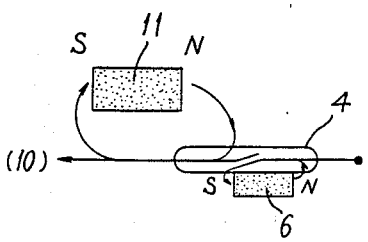
FIGS. 5 and 6 are diagrams used to explain the underlying principle of the present invention.
Figure 6:
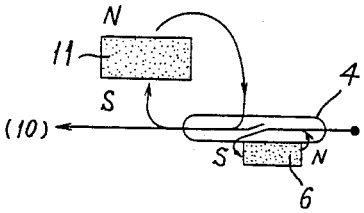

More particularly, as shown in FIG. 5, the first driving magnet 11 is magnetized in the longitudinal direction of the cylinder lock and the outer end (the right end in Fig. 5) is the north pole. It follows therefore that when the first reed switch 4 and the first driving magnet 11 move toward each other as shown, the magnetic flux lines of the first bias magnet and the first driving magnet which flow through the first reed switch 4, made of a magnetic material, are oriented in the same direction. That is, the magnetic flux density passing through the first reed switch 4 is increased so that the first reed switch, which can not be actuated by the first bias magnet 6 only, is now actuated so that first reed switch 4 is closed. Once the reed switch 4 is closed, the bias magnet 6 alone maintains the reed switch 4 in the closed state.

The present invention is not limited to placement of the first driving magnet 11 in the manner described above with reference to FIG. 5. For instance, the first driving magnet 11 is magnetized in the radial direction of the cylinder lock 9 and the outer end (the upper surface in FIG. 6) is defined the north pole as in FIG. 6. The operation is clear from FIG. 6 so that no further explanation shall be made in this specification. So far each driving magnet has been described as being bonded to the holder 13, but it is apparent that the same effects can be attained when the driving magnet is locally and magnetically attached to some portion of a ring-shaped ferrite holder. From the standpoint of the fundamental principle of the operation of the reed switch, it is preferable that the first reed switch 4 and the first driving magnet 11 are juxtaposed as close as possible in the longitudinal direction of the cylinder lock. However, even when the first reed switch 4 and the first driving magnet 11 are not aligned as close as possible as described above and as shown in FIGS. 1, 5 and 6, the contact portion is polarized by the magnetic flux lines passing through the stem exterior of the first reed switch. It follows that longitudinal alignment between the reed switch and the driving magnet does not constitute an essential condition of the present invention.

The second driving magnet 12 is magnetized in the direction opposite to the direction of magnetization of the first driving magnet 11. Therefore, when the second driving magnet 12 and the first reed switch 4 move toward each other, the magnetic flux lines passing through the former are cancelled by the magnetic flux lines produced by the latter such that the first reed switch 4 is not closed. When the first reed switch 4 has been closed by the cooperation of the first reed switch 4 and the first driving magnet 11, the first reed switch 4 being maintained in the closed state by the magnetic force of the first bias magnet 6, the first reed switch 4 may be opened by the second driving magnet 12.

The same is true when the second reed switch 5 and the first driving magnet approach each other.

When the second reed switch 5 and the second driving magnet 12 move toward each other, the former is closed in a manner substantially similar to that described above.

In FIGS. 2 and 3, reference numeral 14 represents a shear line at which rotating and non-rotating parts of the lock meet.

Next, various methods in using keys for cylinder locks will be described because an understanding of these methods is essential for an understanding of the method of operation of the present invention.

The methods for using conventional keys in cylinder locks are generally divided into two methods A and B. In the case of the method A, a user inserts a key into a key hole of a cylinder lock and turns it through a predetermined angle in the clockwise direction or counterclockwise direction and pulls it out of the key hole at the angular position thus determined. In the case of the method B, a user inserts a key into a key hole of a cylinder lock, turns it through a predetermined angle less than 180° in the clockwise or counterclockwise direction and then turns it in the opposite direction; that is, in the counterclockwise direction or clockwise direction and pulls it out of the key hole at the position at which the key was inserted into the key hole. In this specification, the cylinder locks which are operated by method A are referred to as "A" type while those which are operated by method B is referred to as "B" type.

When a cylinder lock is mounted on a door and a key is inserted into the key hole and turned for instance in the clockwise direction (in the case of the B type cylinder locks, the initial clockwise direction) so that the lock is, for instance, locked, the direction in which the cylinder lock is unlocked is uniquely determined as the counterclockwise direction. In the case of the A type cylinder locks, the key is generally rotated through 180°, 360° or 720° to close or open the lock. Therefore, in this specification the cylinder locks in which the key must be rotated through 180° are referred to as "A1 type", those in which the key must be rotated through 360° are referred as "A2 type" and those in which the key must be rotated through 720° are referred to as "A3 type".

There exist, of course, cylinder locks in which the key must be rotated in the counterclockwise direction to lock the lock, but for the sake of understanding of the present invention, it is assumed that the cylinder lock is locked when the key is rotated in the clockwise direction.

The mode of operation of opening or closing (unlocking or locking) the A2 type cylinder lock is now discussed. The upright position of the key hole as shown in FIG. 3 is determined as a reference angular position. The shank 2 (See FIG. 1) of the key is inserted into the key hole 8 in such a manner that the first reed switch 4 is located on the upper side and the key is rotated through 360° in the locking, or clockwise, direction. Due to the mutual action of the bias magnets 6 and 7, the driving magnets 11 and 12 and the reed switches 4 and 5, as shown in row A2 in FIG. 7, the first reed switch 4 is closed at a rotation of 45° and is maintained in the closed state from about 45° to 135° by the first bias magnet 6. In this case, it is assumed that both the first and second reed switches are opened before the key is inserted into the key hole 8. As described above, the first reed switch 4 is maintained in a closed state during the rotation from about 45° to 135° of the key 1 (which is referred to as the $S_1$ state hereinafter in this specification). When the key 1 is rotated about 135°, the first and second reed switches and the second driving magnets 12 are aligned, the first reed switch 4 is opened simultaneously with the closing of the second reed switch 5 and the first reed switch is maintained in the open states $S_2$. Thereafter the state $S_1$ and $S_2$ are alternated. When the key is rotated through 360° and the cylinder lock is closed, the first reed switch is in the state $S_2$ (open) so that when the key 1 is pulled out of the key hole 8, the closed state of the second reed switch 5 is maintained by the second bias magnet. Therefore the locking operation has been memorized in terms of the closed second reed switch in the key 1.

Figure 7:
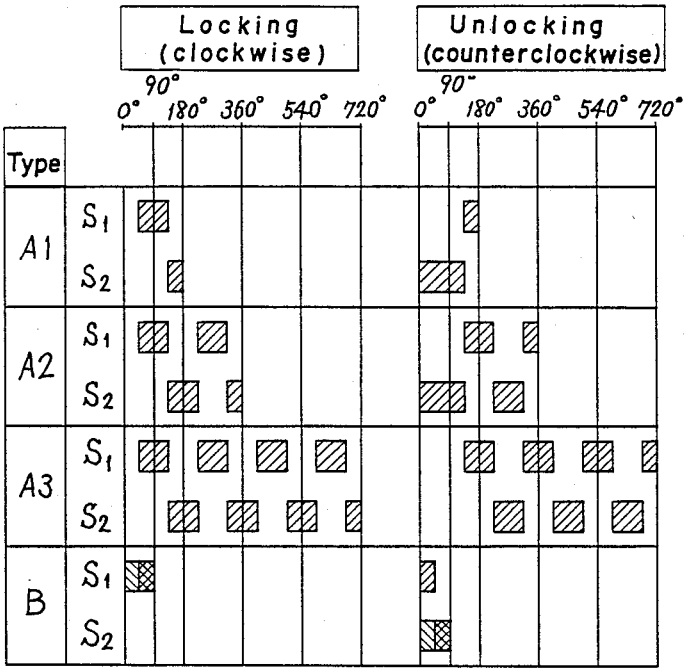
FIG. 7 is a graph illustrating the timing of opening and closing of a reed switch.

As is apparent from row A2 in FIG. 7, when opening the cylinder lock, the first reed switch is driven into the state $S_1$ when the cylinder lock is opened. Therefore the unlocking operation will be memorized in terms of the closed first reed switch 4 in the key 1.

Figure 8:
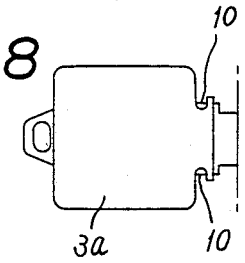
FIG. 8 is a side view of a head of a key.

Furthermore, as shown in FIG. 8, the electrodes 10, 10 are exposed through the cut-out portions of the case 3*a* of the key 1 and are brought into contact with contact terminals so that it can be detected which electrode 10 is in electrical contact with the base plate of the key 1, i.e. which reed switch is closed. Therefore it can be detected whether the cylinder lock is closed or not.

The contact terminals can be provided for every cylinder lock in the holder (but are not shown) and they are brought into contact with the electrodes in response to the rotation of the key.

Figure 9:
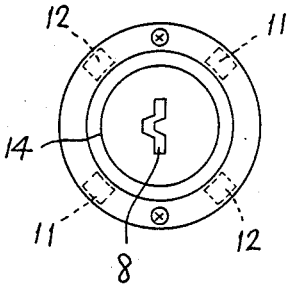
FIGS. 9 and 10 are front views of a cylinder lock in which a key must be rotated 180° when the lock is to be locked or unlocked.
Figure 10:
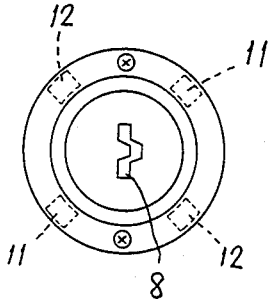

Referring to FIG. 9, the locking and unlocking operations of an A1 type cylinder lock by rotating a key through 180° will be described. In this case, after the cylinder lock is opened or closed, an inner cylinder remains located at the ending angular position. However, when a dead bolt is actuated by a thumb turn or the like from the inside of a room, the phase of the inner cylinder connected to the dead bolt is reversed through 180° so that the position of the key hole 8 is angularly displaced through 180° as shown in FIG. 10. Even starting in the state as shown in FIG. 10, the relative position of the driving magnet 11 (12) with respect to the position of the reed switch 4 (5) will not vary so that, as shown in row A1 in FIG. 7, when the lock is closed, it is maintained in the state $S_2$ so that the key memorizes the locking or unlocking operation as in the case of the A2 type cylinder lock.

As shown in FIGS. 9 and 10, even when the key is inserted into the key hole 8 which is angularly displaced by 180°, the final state of the reed switch 4 (5) remains unchanged. Therefore the present invention can be equally applied to the so-called reversible keys which have the same sawtooth-like pattern on both sides of the key.

In the case of the A3 type cylinder lock which is closed or opened by a rotation through 720° of the key, the signal states $S_1$ and $S_2$ are repeated as shown in row A3 in FIG. 7, so that the key is maintained in the closed state $S_2$ or the open state $S_1$ as in the case of the A1 and A2 type cylinder locks.

The B type cylinder lock is closed or opened by reciprocal rotation (oscillation) through 90° of the key. As shown in row B in FIG. 7, the key 1 is driven into the state $S_1$ when it is rotated through about 45° and this state $S_1$ is maintained during the rotation from 45° to 90° and from 90° to 0° in the whole return stroke, but the key is not driven into the state $S_2$. During opening or unlocking, unlike the locking operation, the key is not driven into the state $S_1$ but is driven into the state $S_2$ when the lock is opened. Therefore, in the case of the B type cylinder lock, the state $S_1$ represents the closed lock while the state $S_2$ represents the opened lock.

It is apparent that the present invention also be applied to B type locks having the so-called reversible key. It should be noted that in FIG. 7, the direction of hatching is reversed in response to the reverse rotation of the key.

In the first embodiment, the memory of the locking or unlocking operation reflected by the closed or opened reed switches can be maintained by the magnetic forces of the bias magnets so that the present invention has the advantage that no further power source is needed.

SECOND EMBODIMENT: FIGS. 11–13

Figure 11:
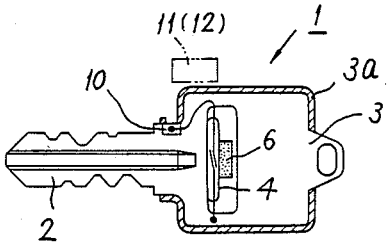
FIG. 11 is a side view in partial section of a key used in a second embodiment of a device for confirming whether or not a lock is locked.

A second embodiment shown in FIG. 11 is substantially similar in construction to the above-described first embodiment except that a single reed switch 4 is extended perpendicular to a shank 2 of a key 1. Therefore the components of the second embodiment similar to those of the first embodiment shall not be described. One end of the reed switch 4 is connected to the base plate of a head 3 while the other end thereof is connected to a single electrode 10 which is electrically isolated.from the base plate. Furthermore, a bias magnet 6 is disposed in the vicinity of the reed switch and has a magnetic flux density such that even when the bias magnet 6 approaches the reed switch 4, the former cannot close the reed switch but can maintain the closed state of the reed switch 4 once the latter is closed. The bias magnet 6 is magnetized in the longitudinal direction of the reed switch 4.

Figure 12:
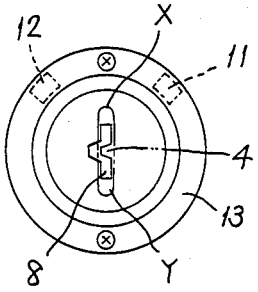
FIG. 12 is a front view of a cylinder lock.

As best shown in FIG. 12, first and second driving magnets 11 and 12 are disposed at the angular positions, respectively, corresponding to one thirty and ten thirty positions in terms of a face of a clock. These driving magnets 11 and 12 are magnetized, for instance, in the radial direction of the cylinder lock.

The directions of the magnetic flux lines of the bias magnet 4 and the first and second driving magnets 11 and 12 are determined in such way that when one or X end of the reed switch is aligned with the first driving magnet 11 (See FIG. 12) or when the other or Y end of the reed switch 4 is aligned with the second driving magnet 12, the magnetic flux lines of the first and second driving magnets are superposed on those of the bias magnet 6, whereby the reed switch 4 is closed. The closed state of the reed switch 4 can be maintained by the magnetic flux of the bias magnet.

When the other or Y end of the reed switch 4 is aligned with the first driving magnet 11 or when the one or X end of the reed switch 4 is aligned with the second driving magnet 12, the magnetic flux lines of the bias magnet 6 and the driving magnet 11 (12) are cancelled by each other, the previous closed state maintained by the bias magnet 6 is opened and is then maintained in the opened state.

Figure 13:
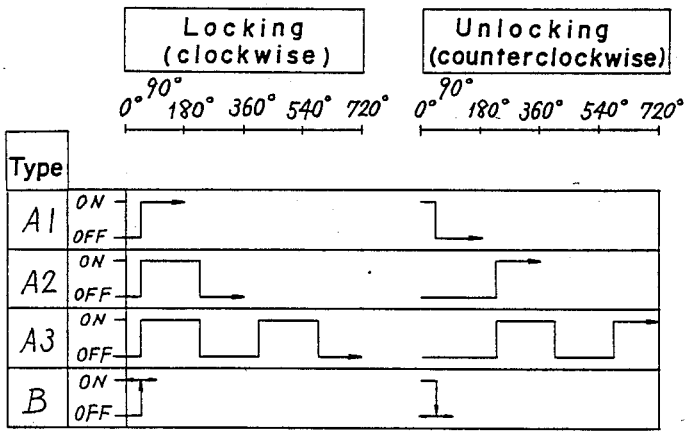
FIG. 13 is a graph illustrating the relationship between the opening and closing of a reed switch and an angle of rotation of a key.

The opened or closed states for A1, A2 and A3 type cylinder locks and the B type cylinder lock in the second embodiment are shown in FIG. 13. Therefore the closing operation is memorized in the key in the terms of a closed state of the reed switch 4 in the case of the A1 of B type cylinder lock, and in the case of the A2 or A3 type cylinder locks, the opened state of the reed switch 4 corresponds to the locking operation of the lock. The opened or closed state of the reed switch 4 is reversed in the case of the unlocking operation. In both cases, the reed switch 4 remains in the opened or closed state until the next cooperation of the magnets.

The second embodiment of the present invention described above has the advantage that no further energy source for the storage of data is needed and furthermore the second embodiment has the advantage that it is simple in construction.

THIRD EMBODIMENT; FIGS. 14–18

Referring to FIGS. 14–18, a third embodiment of the present invention will be described. The third embodiment is substantially similar in construction to the first embodiment described above except that not only are the magnetic flux densities of the first and second bias magnets 6 and 7 selected at a small value such that they cannot close the magnetic flux density of each of the bias magnets 6 and 7 is selected at such a value that the closed state of each reed switch 4 (5) cannot be maintained by the bias magnet 6 (7).

Figure 15:
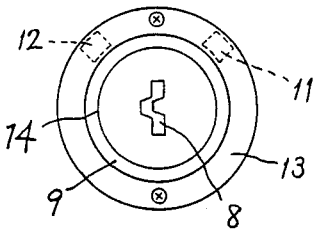
FIG. 15 is a front view of a cylinder lock.

As shown in FIG. 15, a first driving magnet 11 is disposed at a one-thirty position when the outer periphery of the front end face of the cylinder lock 9 is likened to a face of a clock while the second driving magnet 12 is disposed at a ten thirty position.

As in the case of the first embodiment, the first and second driving magnets are magnetized in the opposite directions and when one of the driving magnets 11 and 12 is aligned with one of the bias magnets, the magnetic flux density passing through the corresponding reed switch is increased so that it is closed, but when the driving magnet is aligned with the other bias magnet, the magnetic flux lines which pass through the reed switch cancel each other such that the reed switch is not closed. But according to the third embodiment, it is assumed that the first driving magnet 11 is so magnetized that when it is aligned with the first bias magnet 6, the corresponding first reed switch 4 is closed.

The third embodiment is also different from the first embodiment in that the first and second reed switches 6 and 7 are connected to a control unit 15. A first signal $S_1$ generated when the first reed switch 4 is actuated and a second signal $S_2$ generated when the second reed switch 5 is actuated are delivered to a locking/unlocking signal generator in the control unit 15.

Figure 16:
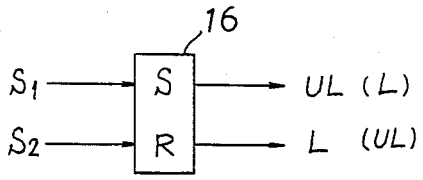
FIG. 16 is a block diagram of a device for generating the lock opening and closing signals.

As shown in FIG. 16, the locking/unlocking signal generator 16 of the third embodiment comprises a set-reset flip-flop (to be referred to only as "the flip-flop" hereinafter in this specification) and the first signal $S_1$ is applied to a set input terminal of the flip-flop 16 while the second signal $S_2$ is applied to a reset input terminal thereof. It is assumed that the locking signal designated by L is generated in response to the locking operation while the unlocking signal designated by UL is generated in response to the unlocking operation. Then in response to the locking mechanism connected to the inner cylinder of the cylinder lock, the locking signal L becomes the positive or negative output of the flip-flop 16 while the unlocking signal U becomes the negative or positive output. That is, of the two output signals from the flip-flop 16, it need not be initially determined which signal is the locking signal L or the unlocking signal UL, but when one output from the flip-flop 16 becomes the locking signal L, the other output becomes the unlocking signal UL.

The mode of operation for locking or unlocking the A2 type cylinder lock will be described. The angular position of a key hole 8 as shown in FIG. 15 is selected as a reference angular position or reference line and a main body 2 (FIG. 14) of a key 1 is inserted into the key hole 8 and then the key 1 is rotated through 360° in the locking direction or clockwise direction. As shown in the row $A_2$ in FIG. 17, when the key 1 is rotated through about 45°, the first reed switch 4 is closed in response to the mutual cooperation of bias magnets 6 and 7 and driving magnets 11 and 12 such that the first signal $S_1$ is generated. When the key 1 is further rotated through about 135° the second signal $S_2$ is generated. As is clear from FIG. 16, in response to the generation of the first signal $S_1$, the negative output is derived from the flip-flop 16, but when the second signal $S_2$ is generated, the reversed negative output is derived from and stored in the flip-flop 16 until the next first signal $S_1$ is generated because of the fundamental function of the set-reset flip-flop 16.

On the other hand, it is assumed that FIG. 15 shows the locked state. Then, in order to unlock the lock, the key 1 is inserted into the key hole 8 and is turned through 360° in the counterclockwise direction so that, as shown in row A2 in FIG. 17, the signal $S_2$ is generated about at the angular position of 225°, but the state of the flip-flop 15 remains unchanged. When the key 1 is further rotated to an angular position of about 315°, the first signal $S_1$ is generated so that the flip-flop 16 is reversed in state and the negative output signal is derived. The negative output signal is, of course, still memorized even after the key is pulled out of the key hole 8 after the unlocking operation.

It follows therefore that in the case of the A2 type cylinder locks, the negative output signal from the flip-flop 16 is used as the locking signal L while the positive output signal is used as the unlocking signal UL.

Figure 14:
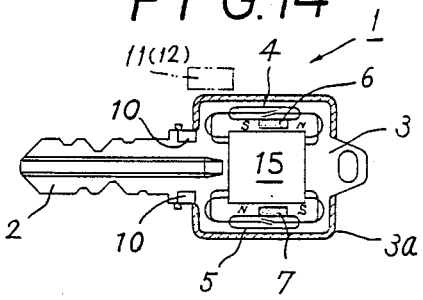
FIG. 14 is a side view in partial section of a key used in a third embodiment of a device for confirming whether or not a cylinder lock is locked.

Furthermore, for instance, as shown in FIG. 14, two electrodes 10 are disposed and electrically isolated from the base plate of the head 3 within the case 3*a* of the head 3 of the key 1 and are electrically connected to the positive and negative terminals of the flip-flop 16 by extending the electrodes 10 through the notches, respectively, cut out in the case 3*a*. When the electrodes 10 are brought into contact with contact terminals it is possible to detect the electrode from which the output signal is derived; that is, whether the locking signal L is generated or the unlocking signal UL is generated. In other words, it can be detected whether the cylinder lock corresponding to the key is in the locked state or in the unlocked state. The contact terminals are provided for cylinder locks in the holder (but are not shown) so that the rotation required for holding the key can be used to place the contact terminals into contact with the electrodes 10.

In the case of the A1 type cylinder lock in which the key must be rotated through 180° for locking or unlocking the lock, when the cylinder lock is opened or closed only by the key, the inner cylinder is located at the same reference angular position after the locking and unlocking operations. However, when the dead bolt is actuated by a thumb turn or the like from the inside of the room, the inner cylinder connected to the dead bolt is reversed by 180° so that the angular position of the key 8 is also angularly displaced by 180° as shown in FIG. 10. In this state, if the first and second driving magnets 11 and 12 are disposed as shown in FIG. 15, neither of the first and second signals is generated. Therefore, as shown in FIGS. 9 and 10, another pair of first and second magnets 11 and 12 are disposed in diametrically symmetrical relationship with the corresponding first and second driving magnets 11 and 12.

Figure 17:
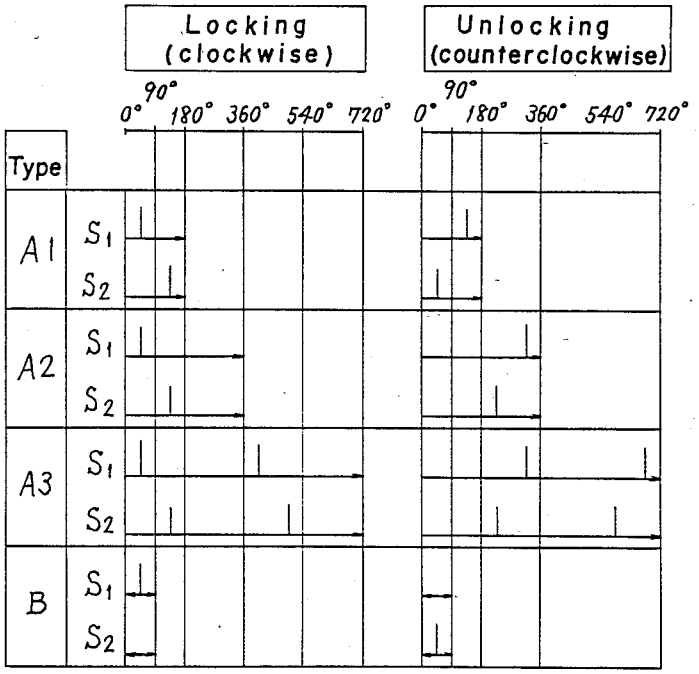
FIG. 17 is a graph of the timing of the generation of the output signal from the reed switch.

In this case, as shown in row A1 in FIG. 17, the signals $S_1$ and $S_2$ are generated such that, like the $A_2$ type cylinder lock, the negative output signal from the flip-flop 16 (FIG. 16) can be used as the locking signal L while the positive signal can be used as the unlocking signal UL.

In the case of the A3 type cylinder lock in which the key must be rotated through 720°, one more pair of signals $S_1$ and $S_2$ appear, as shown in row A3 in FIG. 17, so that in view of the fundamental function of the flip-flop 16, the negative output signal can be used as the locking signal L while the positive output signal can be used as the unlocking signal UL.

Figure 18:
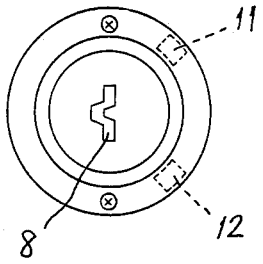
FIG. 18 is a front view of a cylinder lock of the type in which a key is reciprocally rotated.

In the case of the B type cylinder lock which is opened or closed by reciprocally rotating (oscillating) the key, for instance through 90°, the driving magnets 11 and 12 are disposed in symmetrical relationship with respect to a horizontal plane including the axis of the inner cylinder as shown in FIG. 18.

During locking, as shown in the row B in FIG. 17, the first signal $S_1$ is generated when the key is rotated through about 45° and in the return stroke the first signal $S_1$ is generated again at the same angular position, but no $S_2$ signal is generated.

During of unlocking, unlike the locking operation, no first signal $S_1$ is generated, while the second signals $S_2$ are generated twice.

It follows therefore that the positive output signal from the flip-flop 16 can be used as the locking signal L while the negative output signal can be used as the unlocking signal UL.

In the above-described embodiment, the magnetic flux density of each of the bias magnets 6 and 7 is selected at a value at which the corresponding reed switch cannot be actuated by the bias magnet alone. Therefore the reed switch is closed by the cooperation of the bias magnet and its corresponding driving magnet, i.e. by the superposition of the magnetic flux lines of the bias magnet and its corresponding driving magnets. However, in accordance with the present invention, the reed switch may be actuated in response to the magnetic flux density of each bias magnet only. In other words, the reed switch is normally closed, while the corresponding driving magnet is magnetized in the direction in which the magnetic flux lines of the bias magnet will be cancelled, so that when the bias and driving magnets are aligned with each other, the magnetic flux density of the bias magnet is canceled by the driving magnet, thereby permitting the temporary opening of the reed switch. In this case, the output signal from the reed switch is delivered through an inverter (not shown) to the locking/unlocking signal generator 16 (FIG. 16).

Unlike the first and the second embodiments in which the locking and unlocking signals are memorized mechanically by the magnet forces of the bias magnets, the devices in accordance with the third embodiment can prevent an erroneous opening of the reed switch by an impact force, and are thus highly reliable and dependable in operation.

What is claimed is:

1. Device for confirming whether a lock is locked or unlocked, comprising:

a key having a head, said head including at least one reed switch;

a lock capable of being locked and unlocked by said key, said lock having a front face; and switch actuating means, comprising:

at least one bias magnet in said head, each said bias magnet being disposed adjacent a respective said at least one reed switch; and at least one first and at least one second driving magnet connected to said lock and disposed in spaced relation to each other and proximate said front face, the polarity of said at least one first driving magnet being opposite the polarity of said at least one second driving magnet;

whereby when said at least one bias magnet comes into proximity with one of said at least one first or at least one second driving magnets during the locking or unlocking of said lock with said key, said at least one reed switch is appropriately activated according to the resultant strength of the superposed magnetic fields of said at least one bias magnet and said one of said first and second driving magnets.

2. Device for confirming whether a lock is locked or unlocked, comprising:

a key having a head, said head having two sides substantially parallel to and spaced from a longitudinal axis of rotation of said key, and at least one first and at least one second reed switch proximate respective ones of said sides;

a lock capable of being locked and unlocked by rotation of said key about said longitudinal axis within said lock, and lock having a front face; and switch actuating means, comprising:

at least one first and at least one second bias magnet in said head, each said first bias magnet disposed adjacent a respective said at least one first reed switch, each said second bias magnet disposed adjacent a respective said at least one second reed switch, the polarity of said first bias magnet being opposite the polarity of said second bias magnet, the magnetic flux density of said each bias magnet being insufficient to close the associated reed switch but sufficient to maintain the associated reed switch in a closed state; and at least one first and at least one second driving magnet having opposite polarities and being connected to said lock and disposed in spaced alternating relation to each other proximate said front face, each said first driving magnet also being disposed in opposing relationship to a respective said second driving magnet about a reference line, the reference line being normal to the axis of rotation of said key within said lock; whereby when said bias magnets come into proximity with associated ones of said driving magnets during the rotation of said key within said lock, the associated reed switches are appropriately activated according to the resultant strength of the superposed magnetic fields of said bias magnets and said associated ones of said driving magnets.

3. A device as claimed in claim 2, wherein the magnetic flux density of each said driving magnet has a value such that when one of said first bias magnets comes into proximity with one of said first driving magnets, or when one of said second bias magnets comes into proximity with one of said second driving magnets, the magnetic flux density passing through the associated reed switch is increased such that the associated reed switch is or remains closed, and when one of said first bias magnets comes into proximity with one of said second driving magnets, or when one of said second bias magnets comes into proximity with one of said first driving magnets, the magnetic flux density passing through the associated reed switch is cancelled such that the associated reed switch is or remains opened.

4. A device as claimed in claim 2, wherein the main magnetic flux of each of said driving magnets is substantially parallel to the axis of rotation of said key within said lock.

5. A device as claimed in claim 2, wherein the main magnetic flux of each of said driving magnets is substantially radial to the axis of rotation of said key within said lock.

6. A device for confirming whether a lock is locked or unlocked, comprising:

a key having a longitudinal axis and a head, said head including at least one reed switch extending substantially perpendicular to said axis;

a lock capable of being locked and unlocked by rotation of said key about said longitudinal axis within said lock, said lock having a front face; and switch actuating means, comprising:

at least one bias magnet in said head, each said bias magnet disposed adjacent to said substantially magnetically aligned with a respective said at least one reed switch, the magnetic flux density of said each bias magnet being insufficient to close the associated reed switch but sufficient to maintain the associated reed switch in a closed state; and at least one first and at least one second driving magnet connected to said lock and disposed in spaced alternating relation to each other proximate said front face, each said first driving magnet also being disposed in opposing relationship to a respective said second driving magnet about a reference line, the reference line being normal to the axis of rotation of said key within said lock; whereby when said at least one bias magnet comes into proximity to an associated one of said driving magnets during the rotation of said key within said lock, the associated reed switch is appropriately activated according to the resultant strength of the superposed magnetic fields of said bias magnet and said associated one of said driving magnets.

7. A device as claimed in claim 6, wherein said first and said second driving magnets have opposite polarities, and the magnetic flux density of each said driving magnet has a value such that when the north pole of said bias magnet comes into proximity with one of said first driving magnets or the south pole of said bias magnet comes into proximity with one of said second driving magnets, the magnetic flux density passing through the associated reed switch is increased such that the associated reed switch is or remains closed, and when the north pole of said bias magnet comes into proximity with one of said second driving magnets or the south pole of said bias magnet comes into proximity with one of said first driving magnets, the magnetic flux density passing through the associated reed switch is cancelled such that the associated reed switch is or remains opened.

8. A device as claimed in claim 6, wherein the main magnetic flux of each of said driving magnets is substantially parallel to the axis of rotation of said key within said lock.

9. A device as claimed in claim 6, wherein the main magnetic flux of each of said driving magnets is substantially radial to the axis of rotation of said key within said lock.

10. A device for confirming whether a lock is locked or unlocked, comprising:

a key having a head, said head having two sides substantially parallel to and spaced from a longitudinal axis of said key, and at least one first and at least one second reed switch proximate to and substantially aligned with respective ones of said sides;

a lock capable of being locked and unlocked by rotation of said key about said longitudinal axis within said lock, said lock having a front face;

switch actuating means, comprising:

at least one first and at least one second bias magnet, each said first bias magnet being disposed adjacent to and substantially magnetically aligned with a respective said first reed switch, each said second bias magnet being disposed adjacent to and substantially magnetically aligned with a respective said second reed switch, the polarity of said first bias magnet being opposite the polarity of said second bias magnet; and at least one first and at least one second driving magnet having opposite polarities and being connected to said lock and disposed in spaced alternating relation to each other proximate said front face, each said first driving magnet also being disposed in opposing relationship to a respective said second driving magnet about a reference line, the reference line being normal to the axis of rotation of said key within said lock;

signal generation means in said head and electrically connected to said reed switches, said signal generation means generating signals corresponding to locked or unlocked states of said lock in response to the relative actuations of said reed switches; and storage means in said head and electrically connected to said signal generation means, for storing the most recent of said signals from said signal generation means; whereby when said bias magnets come into proximity with associated ones of said driving magnets during the rotation of said key within said lock, the associated reed switches are appropriately activated according to the resultant strength of the superposed magnetic fields of said bias magnets and said associated ones of said driving magnets, said signal generation means generates a signal in response to the relative actuations of the associated reed switches, and said storage means stores said signal.

11. A device as claimed in claim 10, wherein the magnetic flux density of each said bias magnet is insufficient to close the associated reed switch but sufficient to maintain the associated reed switch in a closed state, and the magnetic flux density of each said driving magnet has a value such that when one of said first bias magnets comes into proximity with one of said first driving magnets, or when one of said second bias magnets comes into proximity with one of said second driving magnets, the magnetic flux density passing through the associated reed switch is increased such that the associated reed switch is or remains closed, and when one of said first bias magnets comes into proximity with one of said second driving magnets, or when one of said second bias magnets comes into proximity with one of said first driving magnets, the magnetic flux density passing through the associated reed switch is cancelled such that the associated reed switch is or remains opened.

12. A device as claimed in claim 10, wherein the magnetic flux density of each said bias magnet is sufficient to close the associated reed switches, and the magnetic flux density of each of said driving magnets has a value such that when one of said first bias magnets is in proximity with one of said second driving magnets or when one of said second driving magnets is in proximity with one of said first driving magnets, the magnetic flux density passing through the associated reed switch is cancelled such that the associated reed switch is opened.

13. A device as claimed in claim 10, wherein the main magnetic flux of each of said driving magnets is substantially parallel to the axis of rotation of said key within said lock.

14. A device as claimed in claim 10, wherein the main magnetic flux of each of said driving magnets is substantially radial to the axis of rotation of said key within said lock.

* * * * *